US005771800A

United States Patent [19]

Inamine et al.

[11] Patent Number: 5,771,800

[45] Date of Patent: Jun. 30, 1998

[54] INK SUPPLY CONTROL DEVICE FOR A STENCIL PRINTING MACHINE

[75] Inventors: Noboru Inamine; Atsushi Harada, both of Tokyo-to, Japan

[73] Assignee: Riso Kagaku Corporation, Tokyo, Japan

[21] Appl. No.: 236,007

[22] Filed: May 2, 1994

Related U.S. Application Data

[63] Continuation of Ser. No. 100,342, Aug. 2, 1993, abandoned, which is a continuation of Ser. No. 882,594, May 13, 1992, abandoned.

[30] Foreign Application Priority Data

May 14, 1991 [JP] Japan ..... 3-109201
Apr. 7, 1992 [JP] Japan ..... 4-085544

[51] Int. Cl.[6] ..... B41L 13/00

[52] U.S. Cl. ..... 101/119; 101/364

[58] Field of Search ..... 101/119, 120, 101/148, 350, 363, 364, 360; 346/140 R; 137/101.25; 73/304 R, 304 C

[56] References Cited

U.S. PATENT DOCUMENTS

| | | | |
|---|---|---|---|
| 3,749,009 | 7/1973 | Suzuki | 101/119 |
| 3,890,896 | 6/1975 | Zimmer | 101/119 |
| 4,099,461 | 7/1978 | Mitter | 101/119 |
| 4,479,433 | 10/1984 | MacPhee et al. | 101/364 |
| 4,718,025 | 1/1988 | Minor et al. | 364/550 |
| 4,796,054 | 1/1989 | Maeno et al. | 355/8 |
| 5,103,728 | 4/1992 | Barney | 101/364 |

*Primary Examiner*—Ren Yan
*Attorney, Agent, or Firm*—Dickstein Shapiro Morin & Oshinsky LLP

[57] ABSTRACT

In an ink supply control device for a stencil printing machine which controls the supply of printing ink to an ink reservoir formed in a printing drum according to a signal produced from an ink amount detecting device which produces a first signal when the amount of ink stored in the ink reservoir is detected to be greater than a prescribed level, and a second signal when the amount of ink stored in the ink reservoir is detected to be less than the prescribed level, time durations of the first and second signals over a certain time interval or a certain interval of the rotation of the angle of the printing drum are evaluated as a basis for determining true insufficiency of the level of the printing ink in the ink reservoir through an arithmetic computation to the end of preventing erroneous detection by the ink amount detecting device from adversely affecting the control of the supply of printing ink in the ink reservoir. Such erroneous detection of the level of ink is typically caused by disturbances of short durations in the surface of the ink in the ink reservoir.

31 Claims, 7 Drawing Sheets

INK SUPPLY CONTROL DEVICE FOR A STENCIL PRINTING MACHINE

This application is a continuation of application Ser. No. 8/100,342, filed Aug. 2, 1993, now abandoned, which is a continuation of application Ser. No. 07/882,594, filed May 13, 1992 now abandoned.

TECHNICAL FIELD

The present invention relates to an ink supply control device for a stencil printing machine, and in particular to an ink supply control device which controls the supply of ink to an ink reservoir formed in a printing drum.

BACKGROUND OF THE INVENTION

In a rotary stencil printing machine, an ink reservoir is formed in the interior of a printing drum through which printing ink can pass, and the printing ink stored in the ink reservoir is supplied to the reverse surface of a stencil master plate wrapped around the printing drum, by using a squeegee.

In such a stencil printing machine, it is necessary to maintain the amount of ink stored in the ink reservoir at a prescribed appropriate level throughout the process of stencil printing.

To meet this need, in conventional stencil printing machines, electrostatic capacitance type ink amount detecting means such as those disclosed in Japanese patent laid open publication No. 60-193687 and Japanese utility model laid open publication No. 62-165527, are normally used to detect if the amount of ink in the ink reservoir is less than a prescribed value so that the supply of ink to the ink reservoir may be immediately started when the ink amount detecting means has detected that the amount of ink in the ink reservoir is less than the prescribed value, and may be stopped when the ink amount detecting means has detected that the amount of ink in the ink reservoir is greater than the prescribed value.

During such a process of ink supply control, the ink amount detecting means may erroneously detect the amount of printing ink in the ink reservoir if there is a sloshing, a rippling or a jumping of the ink in the ink reservoir when impulsive force is applied to the ink due to the vibration of the printing drum. In particular, when the ink amount detecting means consists of an electrostatic capacitance type device which employs a needle electrode contacting the printing ink in the ink reservoir, a sloshing, a rippling or a jumping of the printing ink often leads to an erroneous detection of the amount of ink.

Thus, when the supply of printing ink to the ink reservoir is started and stopped according to the result of detecting the amount of ink in the ink reservoir by such ink amount detecting means, the supply of ink to the ink reservoir may not be appropriately carried out due to possible detection errors, and the supply of ink to the ink reservoir may become excessive or insufficient.

Detection errors by ink amount detecting means in detecting the amount of ink tend to be more pronounced when the used printing ink has a low viscosity, and is more prone to sloshing and splashing.

In particular, when a blade type squeegee is used as is the case in the stencil printing machine disclosed in Japanese patent laid open publication No. 03-240584 (patent application No. 02-37178), the squeegee blade is lifted from the inner circumferential surface of the printing drum when the printing drum is within a certain range of its angular position, and this causes movements and fluctuations in the surface level of the ink stored in the ink reservoir, rendering, at least temporarily, accurate detection of the amount of ink impossible. Therefore, when the supply of ink is started and stopped according to a result of such an inaccurate detection result of the ink amount detecting means, the amount of ink in the ink reservoir may become inappropriate.

BRIEF SUMMARY OF THE INVENTION

In view of such problems of the prior art, a primary object of the present invention is to provide an ink supply control device for a stencil printing machine which is capable of appropriate control of the supply of printing ink to the ink reservoir even in the presence of errors in the detected amount of ink by ink amount detecting means so that the amount of ink in the ink reservoir may be maintained at an appropriate level at all times.

A second object of the present invention is to provide an ink supply control device for a stencil printing machine which is simple in structure and can accurately determine the level of printing ink in the ink reservoir without being interfered by disturbances of short durations.

These and other objects of the present invention can be accomplished by providing an ink supply control device for a stencil printing machine which controls the supply of printing ink to an ink reservoir formed in a printing drum according to a signal produced from ink amount detecting means which produces a first signal when the amount of ink stored in the ink reservoir is detected to be greater than a prescribed level, and a second signal when the amount of ink stored in the ink reservoir is detected to be less than the prescribed level, comprising: arithmetic computing means for numerically computing a relative relationship between a time period during which the ink amount detecting means produces the first signal and a time period during which the ink amount detecting means produces the second signal; ink amount determining means for determing if the amount of ink in the ink reservoir is less than the prescribed level or not according to a result of a numerical computation by the arithmetic computing means; and ink supply means for supplying printing ink to the ink reservoir when an output from the ink amount determining means indicates that the amount of ink in said ink reservoir is less than said prescribed level.

According to such a structure, a determination cycle may be defined as a certain angle of rotation by the printing drum or by a certain time period, and, for each determination cycle, the arithmetic computing means numerically computes a relative relationship between the time period during which the ink amount detecting means produces the first signal and the time period during which the ink amount detecting means produces the second signal, for instance a difference between the time periods for producing the first and second signals, the ratio of the time period for producing the first or the second signal to the sum of the periods for producing the first and the second signals, or the ratio between the time periods for producing the first and the second signals. According to a result of this process of numerical computation, the ink amount determining means selectively determines if the amount of ink in the ink reservoir is less than the prescribed value. Therefore, any short term disturbances of the surface of the ink reservoir is cancelled over the determination cycle, and an accurate determination of the level of the printing ink in the ink reservoir is made possible.

According to an alternate embodiment of the present invention, the occurrences of receiving the first and the second signals are up-down counted for each receiving of the output signal from the ink amount detecting means, and the ink amount determining means selectively determines if the amount of ink in the ink reservoir is less than the prescribed level or not according to the final count of the up-down counter.

The ink supply control device of the present invention may further comprise printing ink supply disabled condition detecting means for monitoring the time period during which the amount of ink in the ink reservoir is continually detected to be below the prescribed value by the ink amount detecting means, and, when this time period is longer than a prescribed value, it is determined that the supply of ink to the ink reservoir is disabled, for instance due to the depletion of printing ink in a printing ink source.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
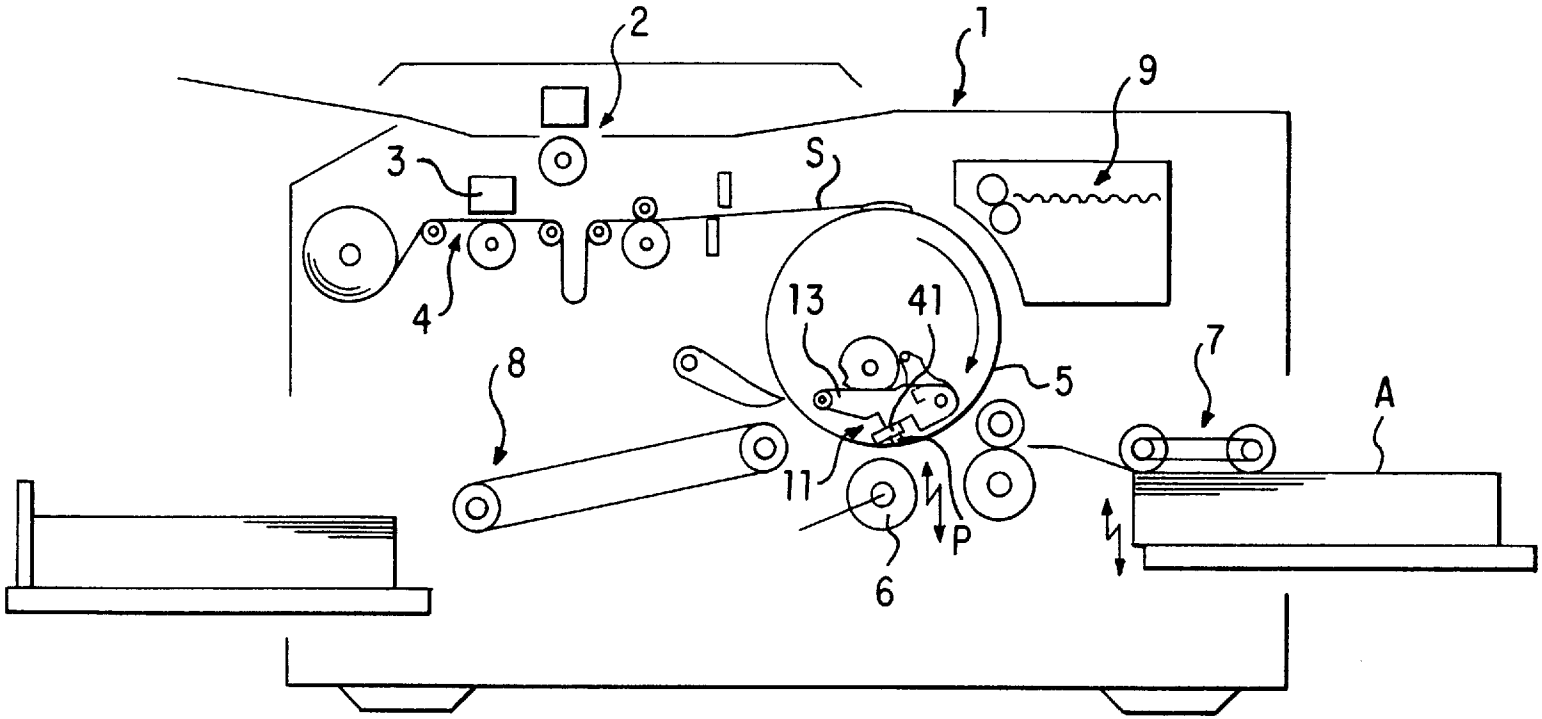
FIG. 1 is a schematic view of the general structure of a stencil printing machine to which the ink supply control device of the present invention is applied.

FIG. 1 shows an overall structure of a stencil printing machine to which the ink supply control device of the present invention may be applied. The stencil printing machine is generally denoted with numeral 1.

The stencil printing machine 1 comprises an original read out unit 2, a master plate making unit 4 including a thermal head 3 for thermally forming a stencil image in a heat-sensitive stencil master plate S according to original image data obtained by the original read out unit 2, a cylindrical printing drum 5 around which a stencil master plate S made by the master plate making unit 4, a press roller 6, a paper feed unit 7 for feeding printing paper P between the printing drum 5 and the press roller 6 sheet by sheet, a paper ejection unit 8 for ejecting and piling the sheets of printed printing paper P into a stack, and a plate ejection unit 9 for removing and discarding the finished stencil master plate S from the printing drum 5, and a blade type squeegee device 11 is incorporated in the printing drum 5.

In this stencil printing machine 1, the printing drum 5 is rotated around a central axial line thereof in clockwise direction as seen in the drawing by rotative drive means not shown in the drawings, and printing paper P is supplied to between the printing drum 5 and the press roller 6 so as to be fed from the right to the left as seen in the drawing in synchronism with the rotation of the printing drum 5. Thereby, the printing paper P is pressed against a stencil master plate S wrapped around the outer circumferential surface of the printing drum 5, and is stencil printed thereon.

Figure 2:
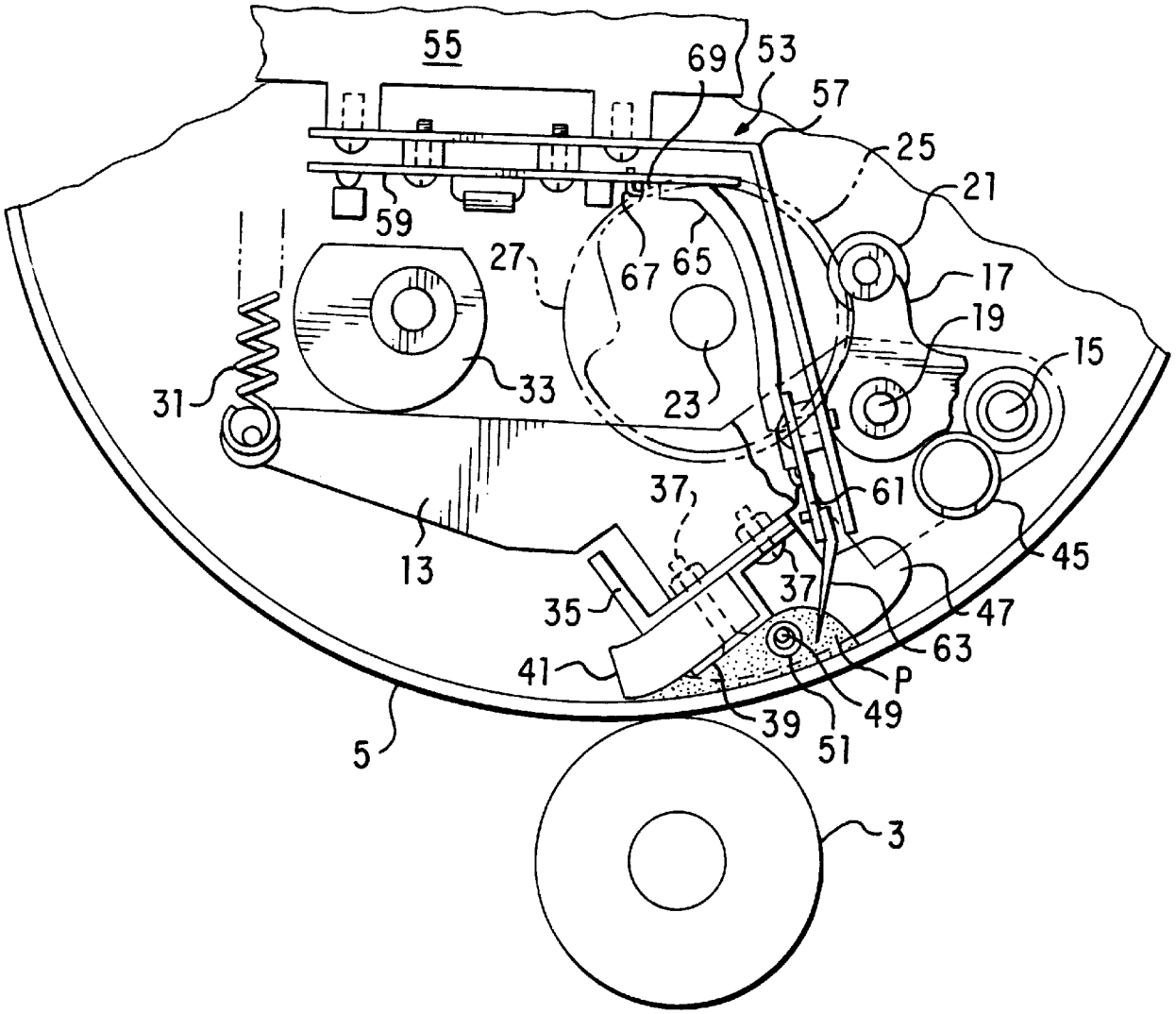
FIG. 2 is a detailed fragmentary side view of a blade type squeegee device of the stencil printing machine to which the ink supply control device of the present invention is applied.

FIG. 2 shows an example of blade type squeegee device 11 in detail. The squeegee device 11 for supplying ink is provided with a pair of squeegee support side plates 13 each on either side thereof, and a connecting shaft 15 extending in parallel with the axial line of the printing drum 5 integrally connects one end portions of the squeegee side plates 13 with each other. An end of a swing lever 17 is pivotally mounted on the connecting shaft 15, and a middle portion of the swing lever 17 is rotatably supported by a support shaft 19 which is in turn secured to a fixed frame portion. The other end of the swing lever 17 rotatably supports a cam follower roller 21.

The cam follower roller 21 is biased in counterclockwise direction as seen in FIG. 2 by a spring mounted on the connecting shaft 15 but not shown in the drawing so as to be engaged with a cam surface of a cam 25 mounted on a cam shaft 23 rotatably supported by the aforementioned fixed frame portion. The cam shaft 23 is rotatively driven by a gear 27 in synchronism with the rotation of the printing drum 5 at the speed ratio of one to one.

The squeegee side plates 13 are biased upwardly as seen in FIG. 2 by a tension coil spring 31 engaged to the other end of one of the squeegee side plate 13 so that the other end may engage with an eccentric cam 31 for the purpose of adjusting the angular position of the squeegee side plates.

Between the squeegee support side plates 13 extends a squeegee support base plate 35 and a squeegee support mounting plate 39 fixedly secured thereto by threaded bolts 37 in parallel with the axial line of the printing drum 5. The squeegee support base plate 35 and the squeegee support mounting plate 39 interpose and securely hold a base end portion of a squeegee blade 41 extending in parallel with the printing drum 5 therebetween.

The squeegee blade 41 is made of rubber like elastic material such as urethane rubber, and an edge on a free end thereof is pushed against the inner circumferential surface of the printing drum 5 at a prescribed squeegee angle.

The squeegee blade 41 forms an ink reservoir P from the printing ink supplied from an ink supply pipe 45 in a triangular region located behind the point of contact with the printing drum 5 or to the right of the point of contact as seen in FIG. 2 as the printing drum 5 rotates, and an ink stirring pipe 51 rotatably supported by a support shaft 49 extending in parallel with the axial line of the printing drum 5 across two side plates 47 of the squeegee support mounting plate 39 is placed in this ink reservoir P.

The supply of the printing ink to the ink reservoir P is made through the ink supply pipe 45, and the printing ink which has been dropped onto the inner circumferential surface of the printing drum 5 from the ink supply pipe 45 moves toward the ink reservoir P by the clockwise rotation of the printing drum 5 as seen in FIG. 2 to be stored therein.

As the printing drum 5 rotates in clockwise direction as seen in FIG. 2, the printing ink in the ink reservoir P rotatively carries the ink stirring pipe 51 therewith by means of its own viscosity, and this causes a clockwise flow of the ink around the ink stirring pipe 51. The ink is stirred by the flow of the ink around the ink stirring pipe 51, and moves sideways so as to evenly distributed over the longitudinal direction of the ink stirring pipe 51. The ink is then pressed by the tip of the squeegee blade 41 onto the printing drum 5.

The squeegee blade 41 is moved away from the inner circumferential surface of the printing drum 5 along with the swing lever 17 and the ink stirring pipe 51 by a cam mechanism consisting of the cam 25 actuated in synchronism with the rotation of the printing drum 5 over a certain angular range of the printing drum 5 determined by the profile of the cam 25. This angular range over which the squeegee blade 41 is moved away from the inner circumferential surface of the printing drum 5 may correspond to a region of the printing drum 5 through which printing ink cannot pass.

When the squeegee blade 41 is moved away from the inner circumferential surface of the printing drum 5, the printing ink in the ink reservoir P sticks to the ink stirring pipe 51 as it is lifted, and the shape of the ink reservoir P undergoes a substantial change.

The control of the supply of ink to the ink reservoir P through the ink supply pipe 45 is carried out according to the amount of ink in the ink reservoir P as detected by an ink amount detecting device 53.

The ink amount detecting device 53 is provided with an ink amount detecting circuit board 59 and an electrode mounting board 61 both fixedly secured to a fixed member 55 via a mounting plate 57. The electrode mounting board 61 carries a needle shaped detection electrode member 63 which is electrically connected to a signal lead of the ink amount detection circuit board 59 via a (central conductor) core wire of a coaxial cable 65, and is disposed opposite to the printing drum 5 which serves as a ground electrode member with the ink reservoir P interposed therebetween. The outer conductor (shield conductor) 69 of the coaxial cable 65 is electrically connected to a ground lead of the ink amount detection circuit board 59 and is thus grounded.

Figure 3:
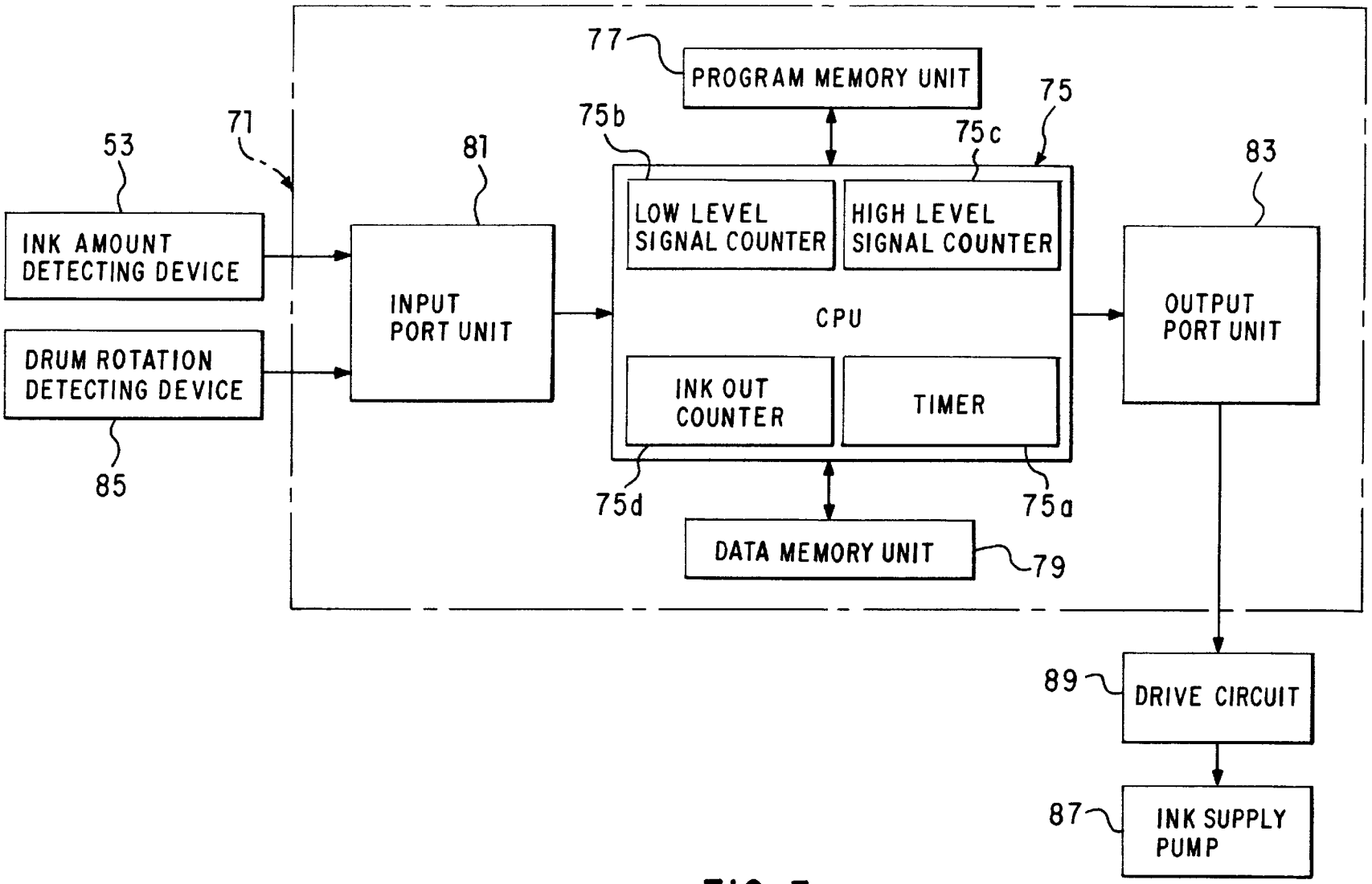
FIG. 3 is a block diagram of a first embodiment of the ink supply control device for a stencil printing machine according to the present invention.

An ink amount detection circuit formed in the ink amount detection circuit board 59 detects a change in the electrostatic capacitance between the detection electrode member 63 and the printing drum 5 due to the change in the amount of ink in the ink reservoir P, and, in the case of the present embodiment, supplies a low level signal as a first signal to an ink supply control device 71, as illustrated in FIG. 3, when the amount of ink in the ink reservoir 63 is greater than a prescribed value, and a high level signal as a second signal to the ink supply control device 71 when the amount of ink is not greater than the prescribed value.

As illustrated in FIG. 3, the ink supply control device 71 consists of a microcomputer comprising a CPU 75, a program memory unit 77, a data memory unit 79, an input port unit 81, and an output port unit 83.

The input port unit 81 is connected to the ink amount detecting device 53 and a drum rotation detection device 85 including a rotary encoder, and receives an output signal from the ink amount detecting device 53, and information on the rotational movement of the printing drum such as whether the printing drum 5 is rotating or not and the rotational angle of the printing drum 5 from the drum rotation detection circuit 85 according to a command from the CPU 75.

The CPU 75 achieves the functions of arithmetic computing means, ink supply determination means, and ink supply disabled condition detecting means by execution of a computer program, and executes the program stored in the program memory unit 77 after each elapsing of a certain time period (time increment) measured by an internal timer or over a certain range of angular position (angular increment) of the printing drum 5, for instance, for each revolution of the printing drum 5, detected by the drum rotation condition detecting device 85, over a certain range of rotational angle of the printing drum as detected by the drum rotation condition detecting device 85, for instance over a full revolution of the printing drum 5, or over a certain time period measured by an internal timer (for instance, a time period required for each revolution of the printing drum) as drum rotation information. Upon each execution of the program, it is determined whether the output signal from the ink amount detecting device 53 is a low level signal or a high level signal, and increments the count of a low level signal counter 75*b* when the output signal from the ink amount detecting device 53 is a low level signal, and increments the count of a high level signal counter 75*c* when the output signal from the ink amount detecting device 53 is a high level signal. The count of the low level signal counter 75*b* is written into the data memory unit 79 as a low level signal output time, while the count of the high level signal counter 75*c* is written into the data memory unit 79 as a high level signal output time. When the printing drum 5 has rotated a certain angle of rotation, over a certain time period or, in other words, upon completion of each cycle of determination process, a relative relationship between the low level signal output time and the high level signal output time written into the data memory unit 79 is numerically calculated.

The numeral calculation of the relative relationship between the low level signal output time and the high level signal output time may consist of the computation of the difference between the low level signal output time and the high level signal output time, the computation of the ratio of the low level signal output time or the high level signal output time to the sum of the low level signal output time and the high level signal output time, or the computation of the ratio of the low level signal output time to the high level signal output time.

The CPU 75 then determines whether the amount of ink in the ink reservoir P is below a prescribed value or not according to the result of such a process of numerical computation, and supplies to the ink reservoir P a control command signal for the supply of printing ink, either an ink supply start control command signal or an ink supply stop control command signal, to a drive circuit 89 of an ink supply pump 87 from the output port unit 83. The ink supply pump 87 is a pump for supplying printing ink to the ink supply pipe 45.

The CPU 75 monitors the time period during which the amount of ink in the ink reservoir P is continually lower than the prescribed value with an internal ink out counter 75*d*, and, when this count exceeds a certain value, meaning that the printing ink in an printing ink supply source (not shown in the drawing) connected to the ink supply pump 85 is depleted, produces an ink out signal to indicate that the supply of ink to the ink reservoir has been made impossible.

Figure 4:
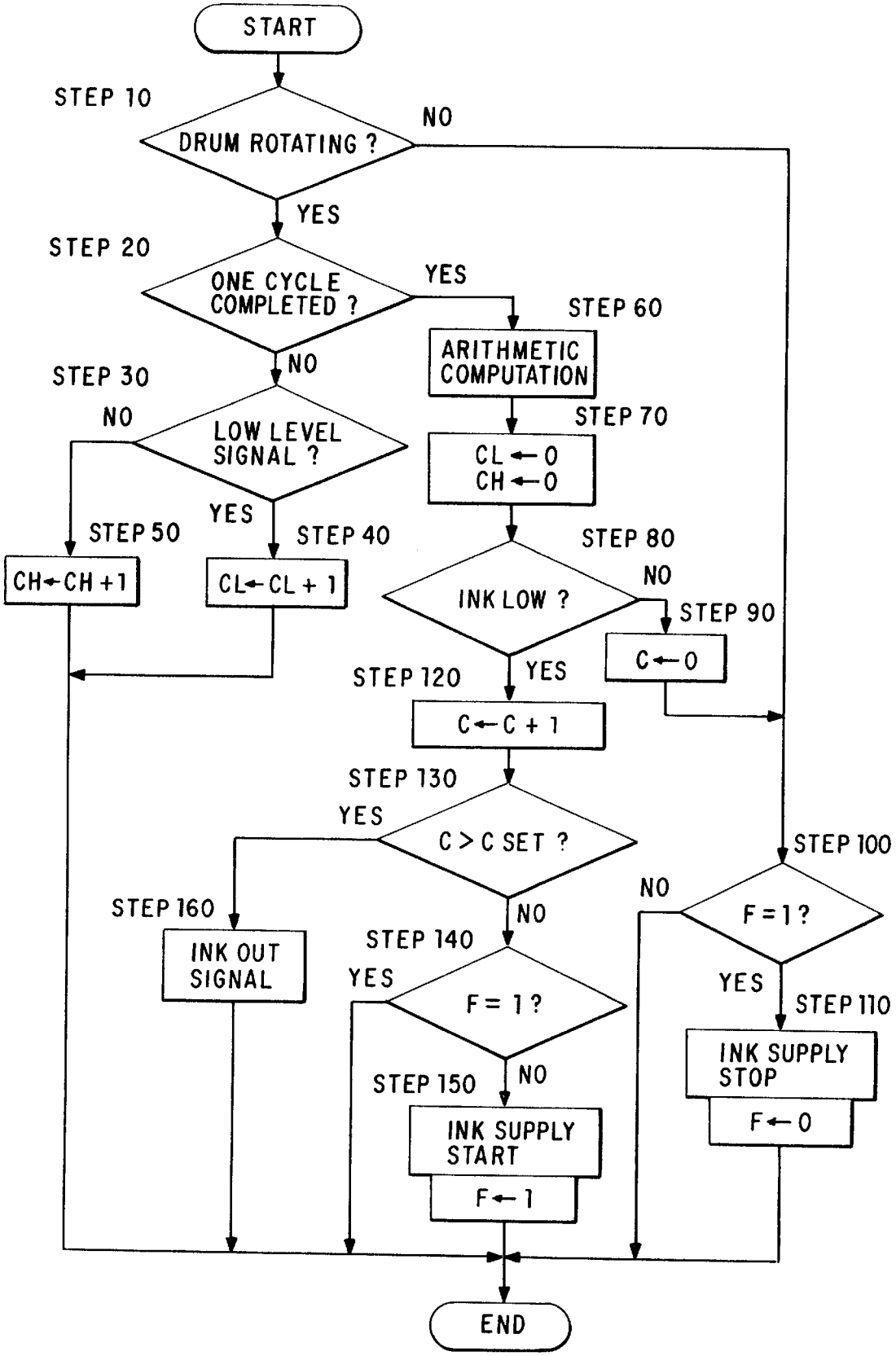
FIG. 4 is a flow chart showing an exemplary operation flow of the first embodiment of the ink supply control device for a stencil printing machine shown in FIG. 3.

FIG. 4 shows a exemplary flow chart of the operation of the ink supply control device described above, and the routine shown in this flow chart is periodically repeated as an interruption routine for each incremental time or for each incremental angle of rotation of the printing drum 5. In this interruption routine, first of all, it is determined whether the printing drum 5 is rotating or not according to a signal from a drum rotation detecting device 85 (step 10). If the printing drum 5 is not rotating, it is determined whether flag F is 1 or not or whether ink is being supplied or not (step 100). If flag F is 1, an ink supply stop command signal is produced, and flag F is restored to 0 (step 110).

On the other hand, if the printing drum 5 is rotating, it is determined if a determination cycle has been completed or not (step 20). The determination of completion of a determination cycle is made by detecting whether the printing drum 5 has rotated a certain angle of rotation, for instance one full revolution, or whether the printing drum 5 has rotated over a certain prescribed time period or not. Until a determination cycle is finally completed, the CPU 75 receives an output signal from the ink amount detecting device 53, and determines if this signal is a low level signal or a high level signal (step 30).

When the output signal from the ink amount detecting device 53 is a low level signal, the count CL of the low level signal counter 75*b* is counted up by one count, and the count is written into a prescribed address of the data memory unit 79 (step 40). On the other hand, when the output signal from the ink amount detecting device 53 is a high level signal, the count CH of the high level signal counter 75*c* is counted up by one count, and this count is written into a prescribed address of the data memory unit 79 (step 50).

Upon completion of a full determination cycle, the count CL of the low level signal counter 75*b* written into the prescribed address of the data memory unit 79 and the count CH of the high level signal counter 75*c* likewise written into the prescribed address of the data memory unit 79 are read out as a low level signal output time and a high level signal output time, respectively, and a relative relationship between the low level signal output time and the high level signal output time is arithmetically computed (step 60).

The arithmetic computation for the relative relationship may consist of an arithmetic computation for finding a relative high level signal output time by subtracting a low level signal output time from a high level signal output time, an arithmetic computation for finding a high level signal output time ratio as a ratio of a high level signal output time to the sum of the high level signal output time and a low level signal output time, and an arithmetic computation for finding the ratio of a high level signal output time to a low level signal output time.

When the arithmetic computation as described above is completed, the count CL of the low level signal counter 75*b* and the count CH of the high level signal counter 75*c* are each restored to zero (step 70).

According to the result of the above described process of arithmetic computation, it is determined whether the amount of ink in the ink reservoir P is below the prescribed value or not, or whether the amount of ink is sufficient or not (step 80). This determination process is based on the comparison of the result of the arithmetic computation such as the relative high level signal output time, the high level signal output time ratio or the relative high level signal output time ratio with a prescribed value defined according to the kind of the result of arithmetic computation, and an insufficiency of printing ink is detected when the relative high level signal output time, the high level signal output time ratio or the relative high level signal output time ratio is higher than such a prescribed value.

When insufficiency of ink is not detected by this determination process, or the amount of ink in the ink reservoir P is determined to be appropriate, the count C of the ink out counter 75*d* is restored to zero (step 90), and the program flow advances to step 100. If ink is being supplied at this time point, or if flag F is 1, an ink supply stop command signal is produced, and flag F is restored to 0 (step 110).

On the other hand, if the amount of ink is determined to be insufficient, the count C of the ink out counter 75*d* is counted up by one count (step 120), and it is determined if this count C is greater than a pre-defined count Cset or not (step 130).

If the count C is not greater than the prescribed counter Cset, it is determined whether flag F is 1 indicating that ink is being supplied (step 140). Otherwise, an ink supply start command signal is produced, and flag F is set to 1 (step 150).

On the other hand, if the count C is greater than Cset, as it means that it has been determined that the amount of ink in the ink reservoir P has been continually determined to be insufficient for more than a prescribed time period, it is determined that the supply of ink to the ink reservoir P has been disabled in spite of the presence of the ink supply start command signal, and an ink out signal is produced (step 160).

Figure 5:
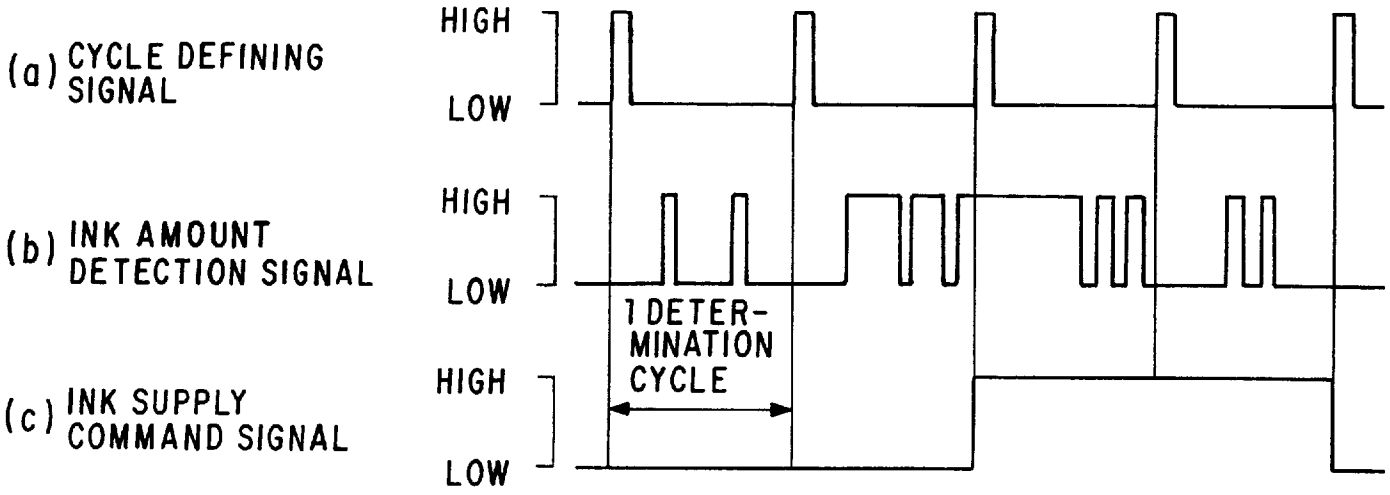
FIG. 5 is a time chart for various signals in the first embodiment of the ink supply control device for a stencil printing machine according to the present invention.

FIG. 5 is a time chart for the above described interruption routine. In FIG. 5, (a) denotes a determination cycle set up signal which changes from a low level to a high level upon each full revolution of the printing drum 5, (b) denotes an output signal from the ink amount detecting circuit 53, and (c) denotes a printing ink supply control command signal which is an ink supply stop command signal when it is low level, and an ink supply start command signal when it is high level.

It can be seen from this time chart that even when the ink amount detecting device 53 may erroneously detect the amount of ink in the ink reservoir P due to the sloshing or the splashing of the printing ink in the ink reservoir P on a temporary basis, any ink supply start signal would not be produced, and an ink supply start signal is produced only after the amount of ink in the ink reservoir P has dropped below the prescribed value.

Figure 6:
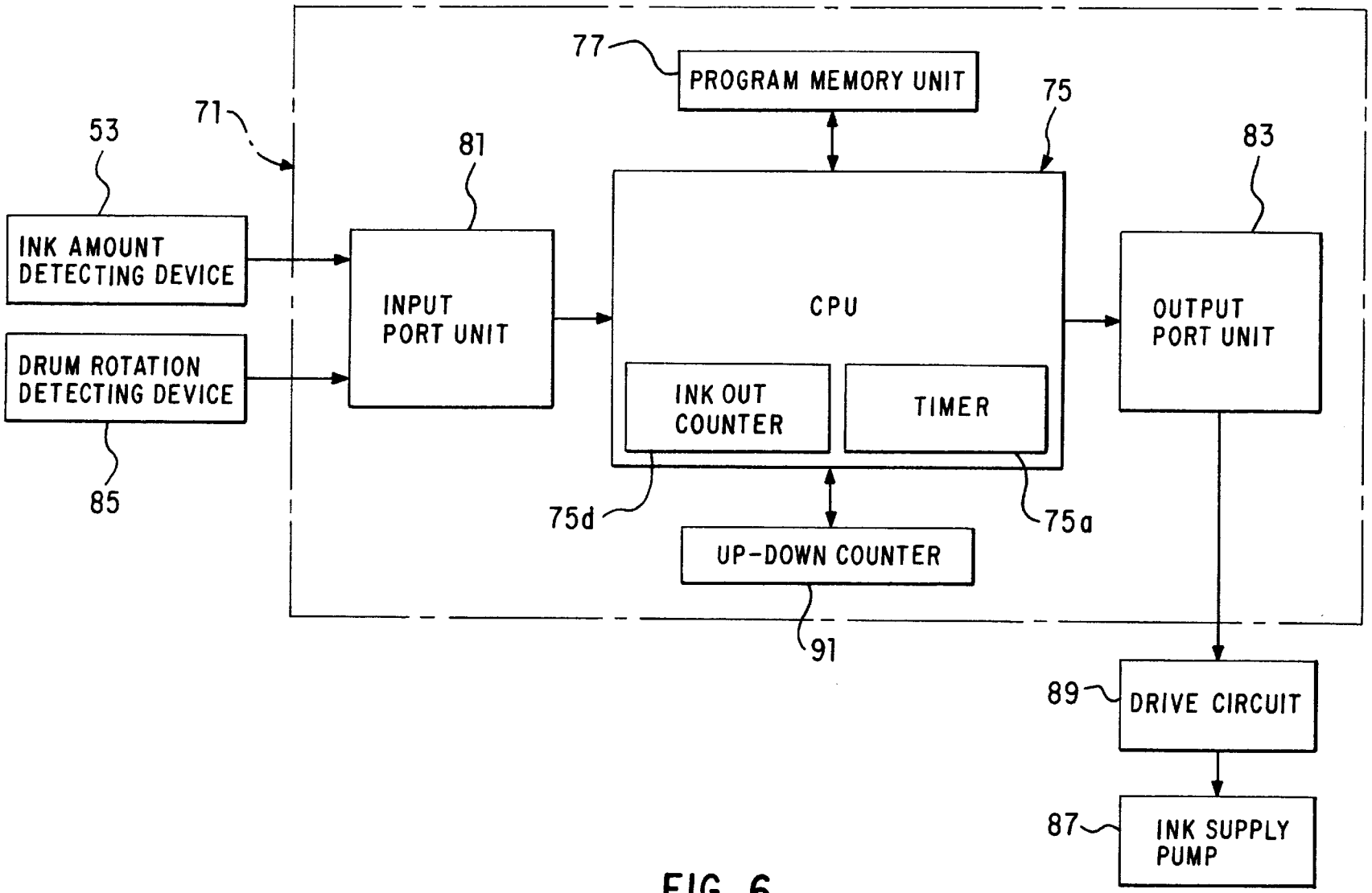
FIG. 6 is a block diagram of a second embodiment of the ink supply control device for a stencil printing machine according to the present invention.

FIG. 6 shows another embodiment of the ink supply control device for a stencil printing machine according to the present invention. In FIG. 6, the parts corresponding to those of FIG. 3 are denoted with like numerals.

This embodiment employs an up-down counter.

In this case, the CPU 75 executes a program stored in the program memory unit 77 over a certain range of angular position of the printing drum 5, for instance one full revolution of the printing drum 5, detected by the drum rotation condition detecting device 85 as drum rotation information, or over a certain prescribed time period (for instance a time period required for a full revolution of the printing drum 5) which is measured by an internal timer, for each increment of time measured by an internal time 75*a* or for each increment of rotational angle by the printing drum 5. Upon each execution of this program, it is determined whether the output signal of the ink amount detecting device 53 is a low level signal or a high level signal, and the up-down counter 91 produces a down count signal when the output signal from the ink amount detecting device 53 is a low level signal, and an up count signal when the output signal from the ink amount detecting device 53 is a high level signal.

The count of the up-down counter 91 is thus equivalent to the difference between the frequency of the detection of the high level signal and the frequency of the detection of the low level signal, or in other words relative insufficiency of the relative output time obtained by subtracting the low level signal output time from the high level signal output time.

Therefore, in this case, the CPU 75 produces an ink supply start control command signal if the count of the up-down counter 91 is greater than a prescribed value, and an ink supply stop control command signal if the count of the up-down counter 91 is smaller than the prescribed value, upon completion of the rotation of the prescribed angle by the printing drum 5, upon completion of the prescribed time period, or upon completion of a full determination cycle.

Figure 7:
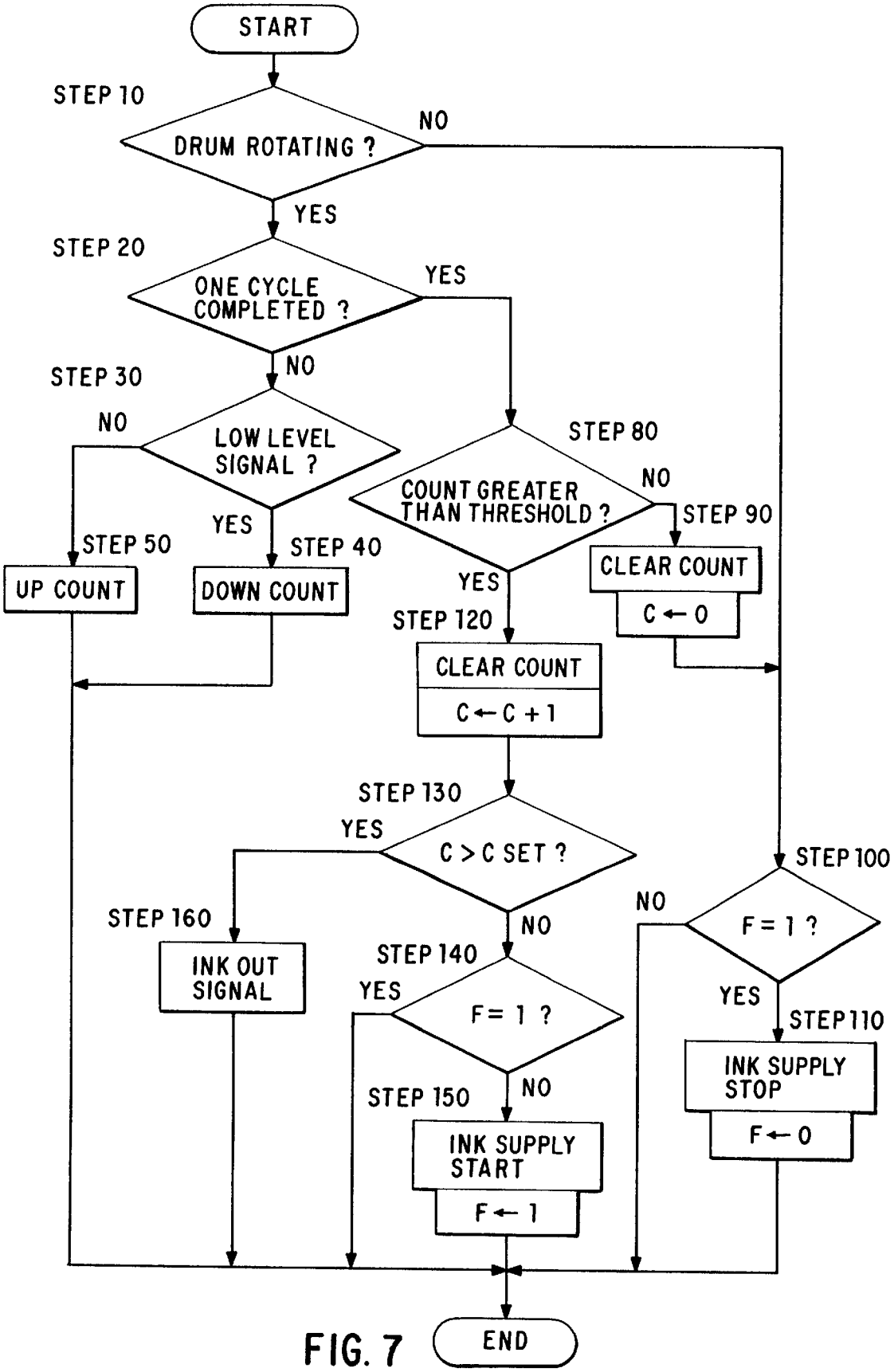
FIG. 7 is a flow chart showing an exemplary operation flow of the second embodiment of the ink supply control device for a stencil printing machine according to the present invention illustrated in FIG. 6.

An exemplary flow chart showing the operation of this ink supply control device is given in FIG. 7. In this case, by execution of steps 30 through 50, a down count is made when the output signal from the ink amount detecting device 53 is a low level signal, and an up count is made when the output signal from the ink amount detecting device 53 is a high level signal, so that the count of the up-down counter 91 always indicates the relative relationship between the low level signal output time and the high level signal output time. Therefore, the step of computing the relative relationship (step 60) of the above described embodiment is omitted in this case.

The range of the rotational angle of the printing drum in which the printing ink in the ink reservoir has a relatively greater tendency to splash such as the range over which the squeegee blade 41 is lifted from the inner circumferential surface of the printing drum 5 is detected from a drum rotational phase signal from the drum rotation condition detecting device 85 or a timer, and the supply of the output signal from the ink amount detection device 53 may be prohibited over this range to remove this range from the interval of data sampling and to increase the accuracy of the process of determining the amount of ink in the ink reservoir P is below the prescribed value or not.

The detection of the amount of ink in the ink reservoir P by the ink amount detecting device 53 may be done in a plurality of locations distributed along the axial direction of the printing drum 5, and the output signal in this case may be an average value of the amounts of ink detected in these locations.

As described above, according to the ink supply control device for a stencil printing machine according to the present invention, a determination cycle is determined as a certain range of rotational angle of the printing drum or a certain time period, and the relative relationship between the time period during which the ink amount detecting device produces the first signal (low level signal) and the time period during which the ink amount detecting device produces the second signal (high level signal) is arithmetically computed so that the determination of the sufficiency of the amount of ink in the ink reservoir P may be carried out in a selective fashion by the ink supply means. Therefore, even when the ink amount detecting means erroneously detects the amount of ink due to the irregularities in the surface of the printing ink in the ink reservoir, the control of the supply of printing ink to the ink reservoir can be carried out in an appropriate fashion.

Further, according to another embodiment of the ink supply control device of the present invention, detection of the output signal from the ink amount detecting device is up-down counted by a counter separately for the first and second signals according to a pre-defined rule, and the determination of the sufficiency of the printing ink in the ink reservoir is similarly made in a selective fashion so that the temporary erroneous detection of the amount of ink by the ink amount detecting means due to the irregularities in the surface of the printing ink in the ink reservoir would not affect the proper control of the supply of printing ink to the ink reservoir.

Further, according to the ink supply control device for a stencil printing machine according to the present invention, the time period during which the amount of ink in the ink reservoir is continually determined to be insufficient is monitored, and if this time period lasts for more than a prescribed time period, it is determined that the supply of ink is disabled. Therefore, the disablement of the supply of ink is also accurately detected irrespective of the occurrence of the erroneous detection of the amount of ink by the ink amount detecting means.

Although the present invention has been described in terms of preferred embodiments thereof, it is obvious to a person skilled in the art that various alterations and modifications are possible without departing from the scope of the present invention which is set forth in the appended claims.

What we claim is:

1. An ink supply control device for a stencil printing machine which controls the supply of printing ink to an ink reservoir formed in a printing drum according to a signal produced from an ink amount detecting device which produces a first signal when the amount of ink stored in said ink reservoir is detected to be greater than a prescribed level, and a second signal when the amount of ink stored in said ink reservoir is detected to be less than said prescribed level, comprising:

an arithmetic computing device for computing a relative relationship between a time period during which said ink amount detecting device produces said first signal and a time period during which said ink amount detecting device produces said second signal;

an ink amount determining device for determining if the amount of ink in said ink reservoir is less than said prescribed level or not according to a result of said computing by said arithmetic computing device; and an ink supply device for supplying printing ink to said ink reservoir when an output from said ink amount determining device indicates that the amount of ink in said ink reservoir is less than said prescribed level.

2. An ink supply control device for a stencil printing machine according to claim 1, wherein said ink amount determining device includes means for supplying said output to said ink supply device for each completion of a certain angle of rotation by said printing drum.

3. An ink supply control device for a stencil printing machine according to claim 1, wherein said ink amount determining device includes means for supplying said output to said ink supply device for each elapsing of a certain time interval.

4. An ink supply control device for a stencil printing machine according to claim 1, wherein said arithmetic computing device includes means for finding a difference between a first time period during which said first signal is produced and a second time period during which said second signal is produced, and comparing said difference with a prescribed threshold value.

5. An ink supply control device for a stencil printing machine according to claim 4, wherein said arithmetic computing device consists of an up-down counter for periodically receiving an output signal from said ink amount detecting device for each prescribed time period, and counting each occurrence of said first and second signals by counting up or down depending on whether said output signal is said first signal or said second signal, said ink amount determining device determining if the amount of ink in said ink reservoir is less than said prescribed level or not according to a final count of said up-down counter.

6. An ink supply control device for a stencil printing machine according to claim 4, wherein said arithmetic computing device consists of an up-down counter for periodically receiving an output signal from said ink amount detecting device for each prescribed rotational angle of said printing drum, and counting each occurrence of said first and second signals by counting up or down depending on whether said output signal is said first signal or said second signal, said ink amount determining device determining if the amount of ink in said ink reservoir is less than said prescribed level or not according to a final count of said up-down counter.

7. An ink supply control device for a stencil printing machine according to claim 4, wherein said arithmetic computing device further includes means for periodically sampling an output of said ink amount detecting device at a certain regular interval of time, and said first and second time periods are given as counts of occurrences of said first and second signals, respectively, in said output from said ink amount detecting device.

8. An ink supply control device for a stencil printing machine according to claim 4, wherein said arithmetic computing device further includes means for periodically sampling an output of said ink amount detecting device at a certain regular interval of a rotational angle of said printing drum, and said first and second time periods are given as counts of occurrences of said first and second signals, respectively, in said output from said ink amount detecting device.

9. An ink supply control device for a stencil printing machine according to claim 1, wherein said arithmetic computing device includes means for finding a ratio of a first time period during which said first signal is produced to a sum of said first time period and a second time period during which said second signal is produced, and comparing said ratio with a prescribed threshold value.

10. An ink supply control device for a stencil printing machine according to claim 9, wherein said arithmetic computing device further includes means for periodically sampling an output of said ink amount detecting device at a certain regular interval of time, and said first and second time periods are given as counts of occurrences of said first and second signals, respectively, in said output from said ink amount detecting device.

11. An ink supply control device for a stencil printing machine according to claim 9, wherein said arithmetic computing device includes means for periodically sampling an output of said ink amount detecting device at a certain regular interval of a rotational angle of said printing drum, and said first and second time periods are given as counts of occurrences of said first and second signals, respectively, in said output from said ink amount detecting device.

12. An ink supply control device for a stencil printing machine according to claim 1, wherein said arithmetic computing device includes means for finding a ratio of a first time period during which said first signal is produced to a second time period during which said second signal is produced, and comparing said ratio with a prescribed threshold value.

13. An ink supply control device for a stencil printing machine according to claim 12, wherein said arithmetic computing device further includes means for periodically sampling an output of said ink amount detecting device at a certain regular interval of time, and said first and second time periods are given as counts of occurrences of said first and second signals, respectively, in said output from said ink amount detecting device.

14. An ink supply control device for a stencil printing machine according to claim 12, wherein said arithmetic computing device further includes means for periodically sampling an output of said ink amount detecting device at a certain regular interval of a rotational angle of said printing drum, and said first and second time periods are given as counts of occurrences of said first and second signals, respectively, in said output from said ink amount detecting device.

15. An ink supply control device for a stencil printing machine according to claim 1, further comprising printing ink supply disabled condition detecting means which monitors a time period during which said ink amount determining means continually determines that the amount of ink in said ink reservoir is less than said prescribed level, and determines that the supply of printing ink to said ink reservoir is disabled when said time period during which said ink amount determining means continually determines that the amount of ink in said ink reservoir is less than said prescribed level is longer than a prescribed time period.

16. A ink supply control device for a stencil printing machine, comprising:

an ink reservoir formed in a printing drum;

an ink amount detecting device which produces a first signal when the amount of ink stored in said ink reservoir is detected to be greater than a prescribed level, and for producing a second signal when the amount of ink stored in said ink reservoir is detected to be less than said prescribed level;

a computer for computing a relative relationship between a time period during which said ink amount detecting device produces said first signal and a time period during which said ink amount detecting device produces said second signal;

an ink amount determining unit for determining if the amount of ink in said ink reservoir is less than said prescribed level or not according to a result of a numerical computation by said computer; and an ink supply for supplying printing ink to said ink reservoir when an output from said ink amount determining unit indicates that the amount of ink in said ink reservoir is less than said prescribed level.

17. An ink supply control device for a stencil printing machine according to claim 16, wherein said ink amount determining unit includes means for supplying said output to said ink supply for each completion of a certain angle of rotation by said printing drum.

18. An ink supply control device for a stencil printing machine according to claim 16, wherein said ink amount determining unit includes means for supplying said output to said ink supply for each elapsing of a certain time interval.

19. An ink supply control device for a stencil printing machine according to claim 16, wherein said computer includes means for finding a difference between a first time period during which said first signal is produced and a second time period during which said second signal is produced, and comparing said differ-ence with a prescribed threshold value.

20. An ink supply control device for a stencil printing machine according to claim 19, wherein said computer further includes means for periodically sampling an output of said ink amount detecting device at a certain regular interval of time, and said first and second time periods are given as counts of occurrences of said first and second signals, respectively, in said output from said ink amount detecting device.

21. An ink supply control device for a stencil printing machine according to claim 19, wherein said computer further includes means for periodically sampling an output of said ink amount detecting device at a certain regular interval of a rotational angle of said printing drum, and said first and second time periods are given as counts of occurrences of said first and second signals, respectively, in said output from said ink amount of detecting device.

22. An ink supply control device for a stencil printing machine according to claim 19, wherein said computer consists of an up-down counter for periodically receiving an output signal from said ink amount detecting device for each prescribed time period, and counting each occurrence of said first and second signals by counting up or down depending on whether said output signal is said first signal or said second signal, said ink amount determining unit determining if the amount of ink in said ink reservoir is less than said prescribed level or not according to a final count of said up-down counter.

23. An ink supply control device for a stencil printing machine according to claim 19, wherein said computer consists of an up-down counter for periodically receiving an output signal from said ink amount detecting device for each prescribed rotational angle of said printing drum, and counting each occurrence of said first and second signals by counting up or down depending on whether said output signal is said first signal or said second signal, said ink amount determining unit determining if the amount of ink in said ink reservoir is less than said prescribed level or not according to a final count of said up-down counter.

24. An ink supply control device for a stencil printing machine according to claim 16, wherein said computer includes means for finding a ratio of a first time period during which said first signal is produced to a sum of said first time period and a second time period during which said second signal is produced, and comparing said ratio with a prescribed threshold value.

25. An ink supply control device for a stencil printing machine according to claim 24, wherein said computer further includes means for periodically sampling an output of said ink amount detecting device at a certain regular interval of time, and said first and second time periods are given as counts of occurrences of said first and second signals, respectively, in said output from said ink amount detecting device.

26. An ink supply control device for a stencil printing machine according to claim 24, wherein said computer further includes means for periodically sampling an output of said ink amount detecting device at a certain regular interval of a rotational angle of said printing drum, and said first and second time periods are given as counts of occurrences of said first and second signals, respectively, in said output from said ink amount detecting device.

27. An ink supply control device for a stencil printing machine according to claim 16, wherein said computer includes means for finding a ratio of a first time period during which said first signal is produced to a second time period during which said second signal is produced, and comparing said ratio with a prescribed threshold value.

28. An ink supply control device for a stencil printing machine according to claim 27, wherein said computer further includes means for periodically sampling an output of said ink amount detecting device at a certain regular interval of time, and said first and second time periods are given as counts of occurrences of said first and second signals, respectively, in said output from said ink amount detecting device.

29. An ink supply control device for a stencil printing machine according to claim 27, wherein said computer further includes means for periodically sampling an output of said ink amount detecting device at a certain regular interval of a rotational angle of said printing drum, and said first and second time periods are given as counts of occurrences of said first and second signals, respectively, in said output from said ink amount detecting device.

30. An ink supply control device for a stencil printing machine according to claim 16, further comprising a printing ink supply disabled detector which monitors a time period during which said ink amount determining unit continually determines that the amount of ink in said ink reservoir is less than said prescribed level, and determines that the supply of printing ink to said ink reservoir is disabled when said time period during which said ink amount determining unit continually determines that the amount of ink in said ink reservoir is less than said prescribed threshold level is longer than a prescribed time period.

31. An ink supply control device for a stencil printing machine according to claim 16, further comprising a drum rotation angle detection device.

* * * * *